US006829928B2

(12) United States Patent
Milone

(10) Patent No.: US 6,829,928 B2
(45) Date of Patent: Dec. 14, 2004

(54) METHOD OF ACCURATELY GAUGING GROUNDWATER AND NONAQUEOUS PHASE LIQUID CONTAMINANTS WHICH ELIMINATES CROSS CONTAMINATION BETWEEN WELLS

(76) Inventor: Christopher J. Milone, 79½ School St., Andover, MA (US) 01810

( * ) Notice: Subject to any disclaimer, the term of this patent is extended or adjusted under 35 U.S.C. 154(b) by 202 days.

(21) Appl. No.: 09/944,767

(22) Filed: Aug. 31, 2001

(65) Prior Publication Data

US 2003/0041662 A1 Mar. 6, 2003

(51) Int. Cl.[7] ..... E21B 49/00

(52) U.S. Cl. ..... 73/152.18; 73/301; 73/299; 73/290 R

(58) Field of Search ..... 73/152.18, 301, 73/299, 290 R, 152

(56) References Cited

U.S. PATENT DOCUMENTS 3,153,342 A * 10/1964 Pierce et al. ..... 73/301
3,511,090 A * 5/1970 Ehrenfried et al. ..... 73/301
3,653,262 A * 4/1972 Ehrenfried et al. ..... 374/142
3,753,200 A * 8/1973 Niejadlik ..... 338/42
3,783,689 A * 1/1974 Ehrenfried et al. ..... 73/301
4,368,639 A * 1/1983 Owens ..... 73/301
4,382,382 A * 5/1983 Wang ..... 73/304 R
4,530,372 A * 7/1985 Overton et al. ..... 137/392
4,679,432 A * 7/1987 Draeger ..... 73/295
4,816,799 A * 3/1989 Ehrenfried et al. ..... 338/13
4,890,492 A * 1/1990 Andrejasich et al. ..... 73/292
4,967,594 A * 11/1990 Ehrenfried et al. ..... 73/301
4,989,452 A * 2/1991 Toon et al. ..... 73/293

OTHER PUBLICATIONS

Solinst, 05/01, "Interface Meter", 1–6.*

* cited by examiner

*Primary Examiner*—Hezron Williams
*Assistant Examiner*—André K. Jackson
(74) *Attorney, Agent, or Firm*—Robert Nathans

(57) ABSTRACT

A dedicated liquid level detection method having a sensor positioned into the casing of a groundwater well. The detector is in the form of an elongated thin film sensor tape that extends along the fill length of the well casing which detects the level, thickness and volume of both groundwater and any light or dense non-aqueous phase liquid that may be present. This is accomplished through the use of a conductive and hydrostatic resistive circuit measuring the level of liquids in a groundwater well at one hundredths of foot resolution or greater. Once the elongated sensor is installed, liquid levels can be gauged from the surface. The data is stored using a battery operated hand held digital display temporarily connected at the top well section casing. Since a sensor probe is not lowered into the well, cross contamination between wells is eliminated.

27 Claims, 5 Drawing Sheets

METHOD OF ACCURATELY GAUGING GROUNDWATER AND NONAQUEOUS PHASE LIQUID CONTAMINANTS WHICH ELIMINATES CROSS CONTAMINATION BETWEEN WELLS

FIELD OF THE INVENTION

The invention relates to the field of measurement of liquid levels in groundwater wells, storage tanks, vessels and other liquid containers.

BACKGROUND OF THE INVENTION

This invention relates to devices known as liquid level detectors, interface probes, and pressure transducers which are used to gauge the depth of groundwater and/or any light non-aqueous phase liquids (LNAPL) or dense non-aqueous phase liquids (DNAPL) i.e. petroleum or solvents respectively, that may be present in groundwater wells, storage tanks, vessels or other liquid containers. Both LNAPL and DNAPL constitute non-electrically conductive fluids.

Traditionally, in accordance with the prior art, monitoring wells are gauged using invasive detection devices with a sensor probe attached to a graduated tape that is wound on a reel. The sensor probe is lowered into the monitoring well casing until the sensor probe comes in contact with the subsurface media i.e. groundwater, in the well. To detect liquids, these devices use an infra-red emitter and detector. When the probe enters a liquid the infra-red beam is refracted away from the detector, which activates an audible alarm and light.

If the liquid is non-conductive (NAPL) the alarm and light are steady. If the liquid is water, a conductive liquid, the water completes a conductivity circuit. This overrides the infrared circuit, and the tone and light are intermittent. The total depth of the well is determined by lowering the sensor probe to the bottom of the well. The measurement is read from the graduated tape and the depth of each media is manually recorded. Errors can be introduced through transcription and by misreading the graduated tape.

If a non-aqueous NAPL such as petroleum is present, the sensor probe and measurement tape can become smeared with petroleum, which in some cases can be difficult to completely remove from the sensor probe and tape. The decontamination process must be thorough to avoid leaving behind any petroleum residues. In accordance with state and federal environmental regulations, these devices must be thoroughly decontaminated between use in each monitoring well to prevent cross-contamination from well to well in subsurface groundwater. This is an important step in the prior process which is time consuming and consequently costly. In addition, when the probe is removed the field personnel gauging the well, run the risk of being exposed to contaminants in the well.

The present invention avoids prior art tape-reading errors and transcription errors by displaying the gauged values on a hand-held digital display unit where they can be stored electronically and later transferred directly to a computer. There is no decontamination procedure necessary, since the sensor tape is part of the well and there is no contact with contaminated groundwater which can be transferred from one well to the next or from the well to field personnel.

Regarding groundwater sampling and well volumes, in order to determine groundwater quality it is necessary to collect samples of groundwater and submit them for laboratory analysis. Prior to collecting a groundwater sample a specified volume of groundwater (typically 3 well volumes) must be withdrawn from the well in order to obtain a sample representative of the aquifer. The volume of groundwater within the monitoring well casing is calculated using the measured depth to water and total depth of the well. In addition it is necessary to determine the volumes of any NAPL that may be present in a well to determine the extent of release of such liquids. The invention disclosed herein, calculates and displays the thickness and volume of water and any LNAPL or DNAPL on the hand held digital display unit.

Aquifer tests such as pumping tests and slug tests are used to determine site-specific aquifer parameters such as hydraulic conductivity, transmissivity and storage coefficients. These tests are performed while groundwater levels in monitoring wells are continuously monitored and recorded. This is typically accomplished through the use of a pressure transducer probe installed in a monitoring well, penetrating the groundwater and attached via chords to a data logger at the surface. These data loggers collect and store the groundwater level data for subsequent determination of aquifer parameters. The pressure transducers must also be decontaminated between each use to prevent cross-contamination.

The invention disclosed herein can also monitor and store groundwater level data during these aquifer tests for subsequent determination of aquifer parameters.

Regarding well locating, it is sometimes difficult to determine if the well being gauged or sampled is the well of interest. This is particularly a problem at sites with numerous wells located relatively close together and installed at similar depths. Groundwater data collected is invaluable in determining site conditions accurately and gauging and sampling the correct well is paramount.

In the aforesaid prior art apparatus, an elongated resistive sensor tape was employed to detect the level of a liquid using the hydrostatic pressure of the liquid in which it is immersed. The hydrostatic sensor consists of a conductive base strip that is partially insulated from a resistive wire that is wound around the base strip to form a helix. The sensor tape is encapsulated in an outer protective envelope to insulate the sensor from the liquid in which it is immersed. When the sensor is immersed in a liquid the hydrostatic pressure of the liquid compresses the envelope. This causes the wire to contact the base strip, which results in a change in resistance of the wire. The resistance of the wound wire corresponds to the distance from the top of the sensor tape to the liquid surface. See U.S. Pat. No. 4,816,799 to Ehrenfried et al., assigned to Metritape Inc. of Littleton. Mass.

A disadvantage of this prior art sensor is that it only can detect the level of a single liquid, e.g. water or petroleum. The sensor can not distinguish between the two in the same well, tank or vessel. In addition, the resolution of the sensor is limited by the minimum spacing between windings of the resistive wire (two hundredths of a foot).

The invention disclosed herein, utilizes an elongated resistive sensor tape that incorporates both a hydrostatic and conductive resistive circuit capable of distinguishing between a conductive liquid (water) and a non-conductive liquid (petroleum) at a resolution of one hundredth of a foot and greater. The resolution is limited only by the smallest spacing possible between contacts of individual thin film transistor circuits in the neighborhood of micrometers.

SUMMARY OF A PREFERRED EMBODIMENT OF THE INVENTION

An elongate thin film sensor tape circuit 1, in FIG. 1, is incorporated into the inside annulus of a groundwater well casing 3 so that is in contact with any liquid present in the well. The sensor tape's outer jacket has a smooth nonstick surface to prevent build up of highly viscous liquids and includes a conductive resistive circuit that detects the level of water that conducts current in contrast with contaminants. An array of tiny stainless steel electrodes 5 exposed at the surface of the sensor tape at 0.01-foot intervals along the length of the sensor tape, sense the presence of water such that an electrical resistance measured at the top of the well casing is proportional to the depth of the water in the well. The thin film sensor tape circuit also includes a hydrostatic sensing circuit 7 that is sensitive to the actuation pressure of any liquid, (water or NAPL), in which it is immersed. This circuit consists of a network of resistors 9 with an intervening pair of contacts 11 at 0.01-foot intervals. As the level of the liquid rises, the increased hydrostatic pressure of the liquid compresses a movable overlying metal base strip incorporated in the outer jacket of the sensor tape against the contacts such that the electrical resistance measured at the top of the well casing is proportional to the depth of the liquid in the well. Regarding this device, note the hydrostatic sensor of the aforesaid Ehrenfiied patent discussed above. In addition the sensor tape includes a series network of resistors 13 proportional to the total length of the sensor tape sections.

The sensor tape 1 extends along the full length of each well section. The well casing consists of one, two, five or ten-foot modular sections of slotted well screen or blank casing, which have the sensor tape incorporated therein. The modular sections 3 can be connected using various lengths to obtain the desired well depth. Specialized bottom and top cap sections, 15 and 17 respectively, are connected to complete the sensor circuit. The top cap, in addition to completing the circuit, houses the display connector and a nonvolatile memory circuit that stores pertinent well information such as: the identification number; installer; installation date; depth; diameter; and top of casing elevation. Electrical interconnects are made in the coupling of the modular well casing sections using a specialized connector and double o-ring arrangement to prevent exposure of the connections to the liquid in which it is immersed. A hand held digital processor unit measures the electrical resistances at the surface of the well casing, calculates and displays the level, thickness and volume of water and any light LNAPL or dense DNAPL.

DETAILED DESCRIPTION OF PREFERRED EMBODIMENTS OF THE INVENTION

Figure 1:
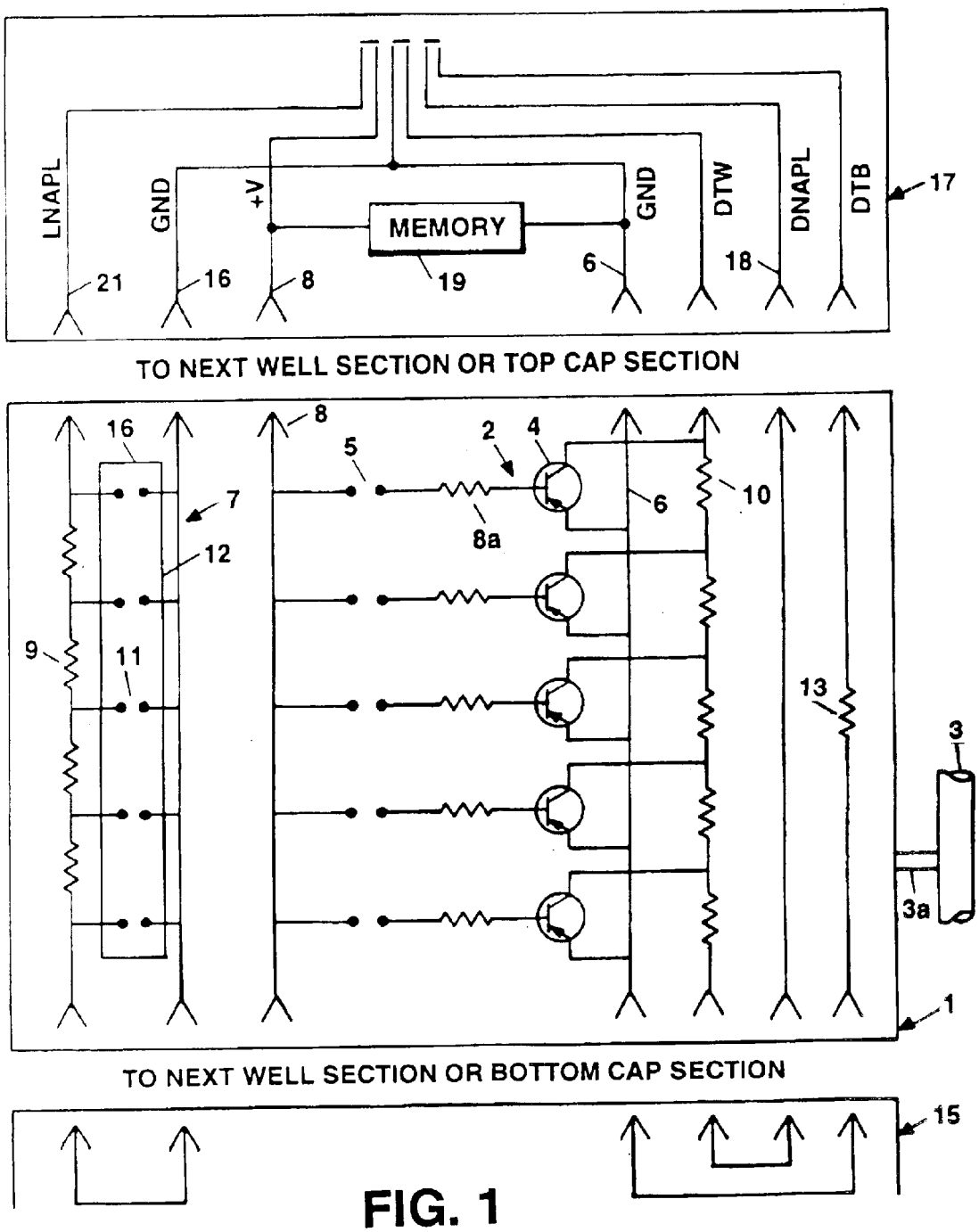
FIGS. 1 and 5 disclose a preferred embodiment of the invention.
Figure 2:
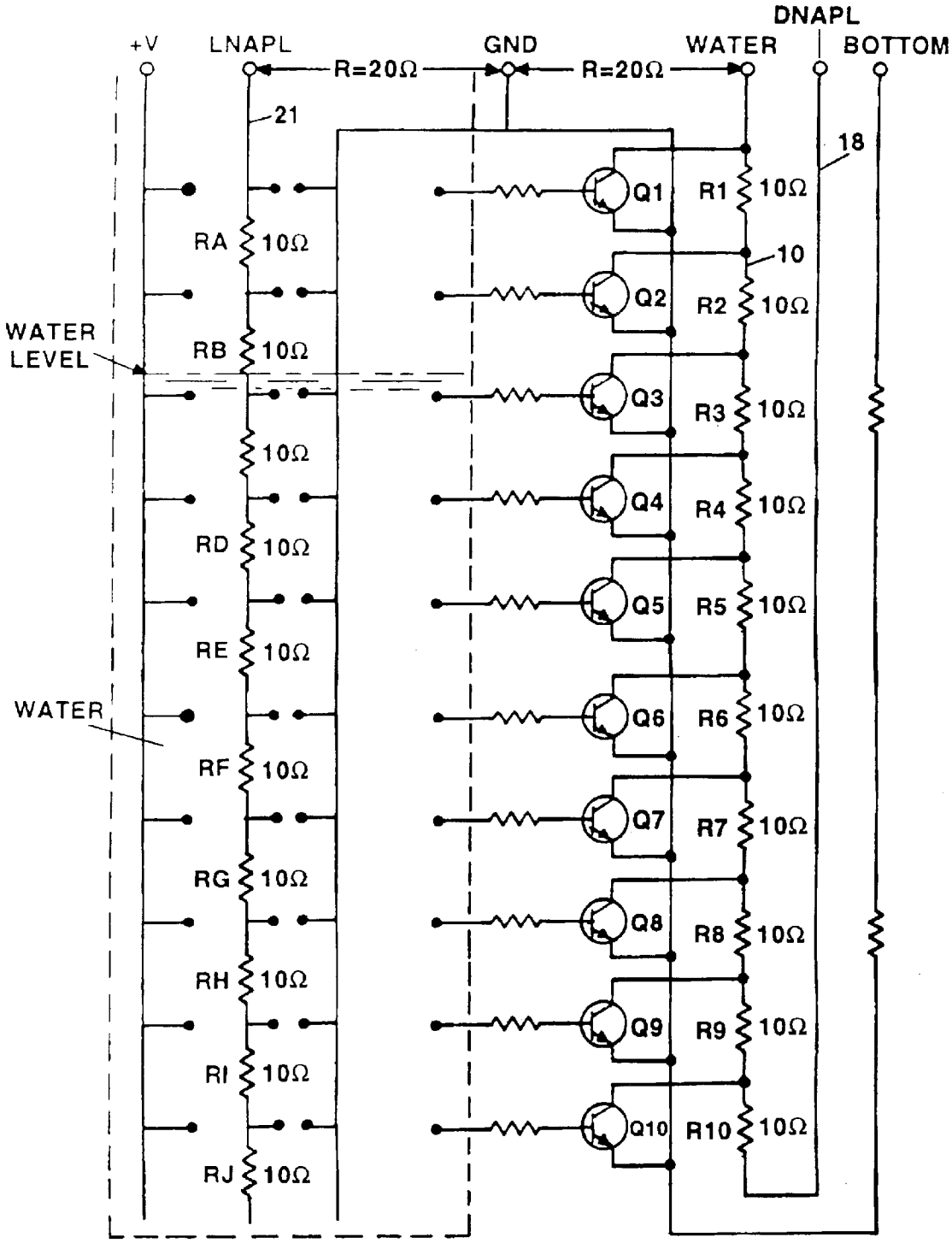
FIG. 2 illustrates measurement of a column of water.

Referring now to FIGS. 1 and 2, an elongate thin film sensor tape circuit 1 includes a conductive resistive circuit that distinguishes between water a conductive liquid and NAPL a non-conductive liquid. The water detecting conductive circuit 2 is comprised of a series of transistor switches 4 with the collector lead of each transistor tapping a series network 10 of, for example, 10-ohm resistors so that one resistor separates each successive collector lead as shown in FIG. 1*a*. The emitter lead of each transistor is tied to ground lead 6. When there is no water bridging the contacts 5 between the source voltage lead 8 and its associated base resistor 8*a*, the transistor is cut off and acts like and open switch from the collector to the emitter. When water bridges the contacts between the source voltage and the base resistor a sufficient base current is allowed to flow and drive the transistor into saturation and the transistor acts like a closed switch from the collector to the emitter. When no water is present, all the transistor switches are open and the resistance as measured from the top of the series resistor network 10 to ground is infinite (i.e. an open circuit) as there is no return path to ground. When water enters the well and trips the lowest transistor switch Q10, the resistance as measured from the top of the series resistor network 10 to ground is the total sum of all the resistors in series. As the level of water rises, successive contacts 5 are bridged, closing successive transistor switches; successive resistors are effectively removed from the series resistor network. This decreases the resistance as measured from the top of the well casing. Thus, the measured resistance, or conductive liquid output signal fed to data processor 25 shown in FIG. 5, is proportional to the depth of water in the well.

The thin film sensor tape circuit 1 also includes a hydrostatic sensing circuit 7 that is sensitive to the actuation pressure of any liquid (conductive or nonconductive) in which it is immersed. This circuit consists of a series network of resistors 9 with pairs of intervening contacts at 0.01-foot spacing. One contact is connected between each successive resistor in the series network; the other is connected to ground lead 16. As the level of the liquid rises the hydrostatic pressure of the liquid compresses a slightly movable overlying metal base strip 12 against the circuit contacts and successive contacts are bridged. This effectively removes successive resistors from the series resistor network and decreases the resistance as measured from the top of the well casing. Thus, the measured resistance is proportional to the depth of any type of liquid in the well and thus constitutes an all liquid output signal fed to the data processor 25 shown in FIG. 5. In addition, the sensor tape includes a series resistor network 13 proportional to the total length of the sensor tape 1. Each sensor tape section contains a resistor proportional the length of that section. When well sections are connected in tandem, to extend the sensor tape to the bottom of the well, the resistance as measured from the top of the well casing is proportional to the total depth of the well.

Figure 5:
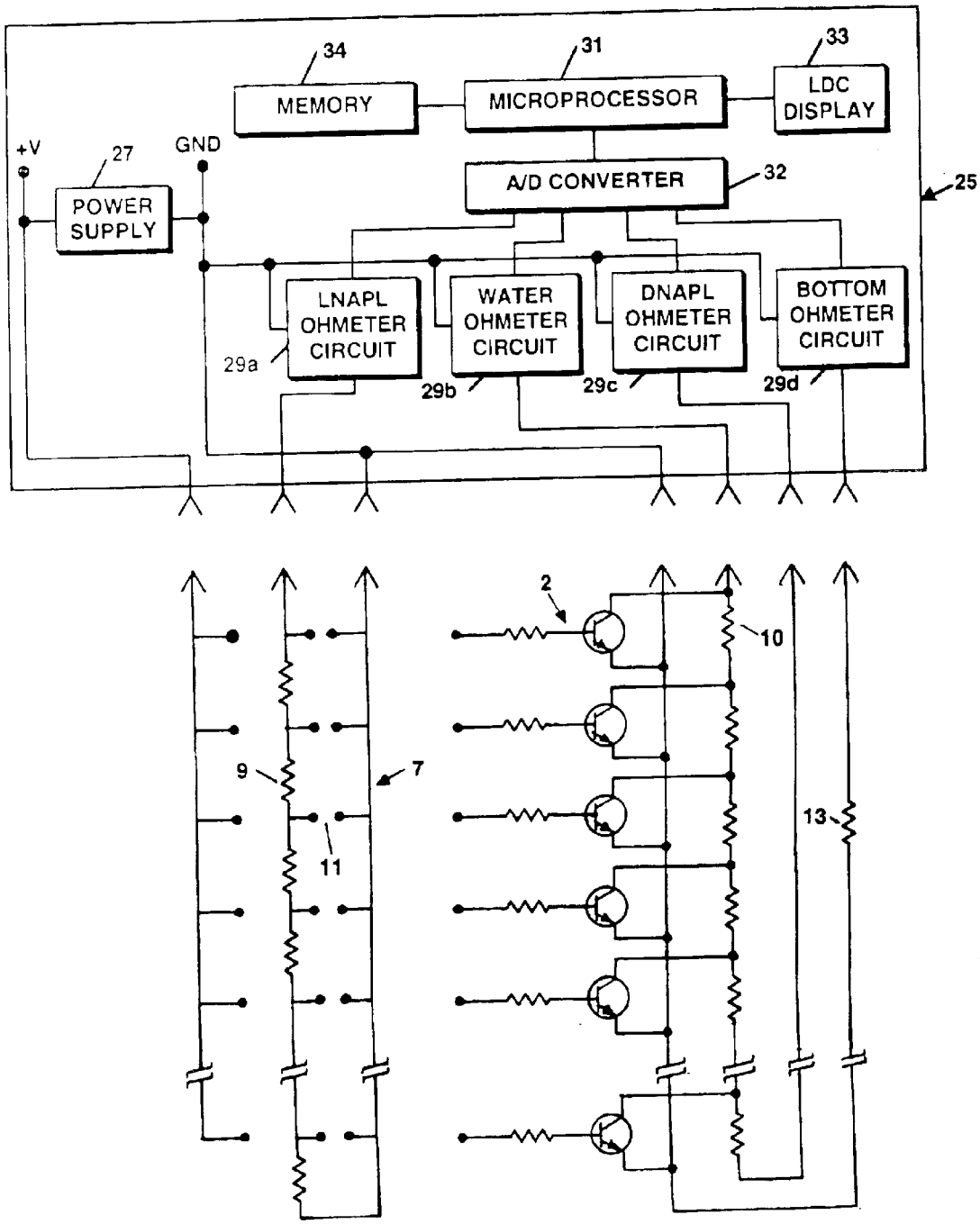

The presence, depth, thickness and volume of water and any DNAPL or LNAPL are preferably carried out in the data processor 25 of FIG. 5. These parameters are determined as follows: the depth of water in the well is determined by measuring the effective resistance of the conductive circuit 2 as discussed above. The layer thickness or height of the water column in the well can then be determined by subtracting the measured resistance of the conductive circuit from the measured resistance 13 of the total depth of the well. The volume of water in the well is calculated using the measured layer thickness of the water and the inside diameter of the well casing.

Regarding LNAPL, the depth of any floating LNAFL is determined by measuring the resistance of the hydrostatic circuit 7 from the top of the well casing. Note that the LNAPL resistance measuting terminal 21 is connected to the top of the resistance network 9 of the hydrostatic circuit 7. If the measured resistance of the hydrostatic circuit 7 is equal to the measured resistance of the water detecting conductive circuit 2 when the two signals are compared, then no LNAPL is present. If the measured resistance of the hydrostatic circuit is less than the measured resistance of the conductive circuit when the two signals are compared, then a LNAPL is present and this measured resistance represent the depth of the LNAPL. The thickness of the LNAPL can then be determined by subtracting the measured resistance of the hydrostatic circuit from the measured resistance of the conductive circuit. The volume of LNAPL in the well is calculated using the measured thickness or height of the LNAFL and the inside diameter of the well casing.

Regarding DNAPL, the depth of any sinking DNAPL in the well is determined by measuring the resistance of the conductive circuit from the bottom of the well casing. Note that the DNAPL terminal 18 is connected to the bottom of the resistance network 10 of the conductive circuit 2. If this measured resistance is equal to zero-Ohms, then there is no DNAPL present as the presence of water at the bottom produces a ground condition there. If the measured resistance is greater than zero-Ohms then there is DNAPL present and this measured resistance corresponds to the thickness of the DNAPL layer. The depth of DNAPL is determined by subtracting the thickness of the DNAPL from the measured resistance of the total depth of the well. The volume of DNAPL in the well is calculated using the measured layer thickness of the DNAPL and the inside diameter of the well casing.

The battery operated, hand held digital processor/display unit 25 of FIG. 5, is connected to the top of the well casing as shown, to measure the aforesaid resistance values. The display unit 25 consists of a power supply circuit 27, resistance measuring circuits 29*a*-29*d*, (ohmmeters), an analog to digital converter 32 and microprocessor 31 to translate the measured values for processing and performing the calculations and displaying the level, thickness and volume of water and any LNAPL or DNAPL present on liquid crystal display 33. Memory 34 includes software to translate the data. The unit 25 is temporarily connected to the top section of each well being evaluated and can store data from many wells. The unit can then be taken back to the office and the data can be transferred to a PC. Specific well information such as well identification number, and depth, diameter and top of casing elevation resides in a memory chip in the top section of the well.

Thus, data processor 25 positioned at the top of the well processes the conductive liquid output signal and the all liquids output signal for determining thickness of layers of groundwater and any light or dense non-aqueous non-electrically conductive phase liquid in said well.

To provide further clarification, the following examples are provided which employ a single hypothetical 0.10 foot tape section positioned in a hypothetical "well" having a depth of 0.10 foot. Of course, for a real well, much longer and numerous tape sections are coupled together in tandem as mentioned previously. More specifically, die depth of water in the well is determined by measuring the effective resistance of the conductive circuit 2 as shown in FIG. 1. In the example shown in FIG. 2 the water level in the well is at the level of the contacts at transistor Q3. The water bridges the contacts and current is allowed to flow to transistor Q3 and the transistor behaves like a closed grounding switch from the collector to the emitter. Therefore, the resistance measured from the top of the well to the resulting pound is 20-ohms, which is the sum of the two 10-ohm resistors (R1+R2). This corresponds to a depth to water of 0.02 feet (10-ohms per 0.01-feet). The thickness or height of the water column in the well can then be determined by subtracting the measured resistance of the conductive circuit (depth to water) from the measured resistance of the total depth of 0.10 foot, of the hypothetical well. Since the contacts are spaced at 0.01-foot intervals, in this example the well is only 0.10 feet deep. The thickness of the water column is equal to:

0.10 feet−0.02 feet=0.08 feet.

The volume of water in the well is calculated using the measured thickness of the water and the inside diameter of the well casing (i.e. pi×radius squared x height the volume of a cylinder).

Figure 3:
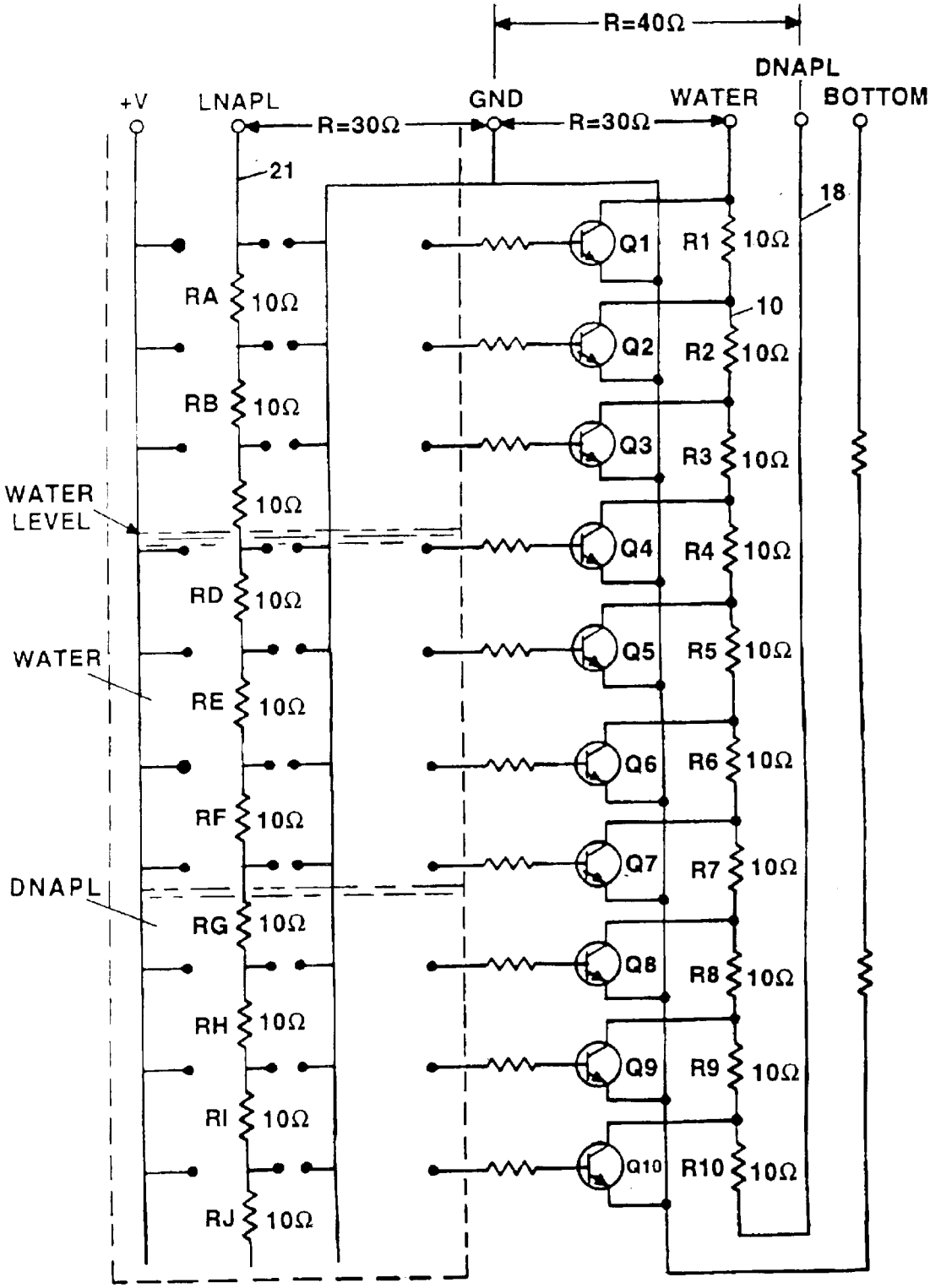
FIG. 3 illustrates measurement of a layer of DNAPL.

The depth of any DNAPL in the well is determined by measuring the resistance of the conductive circuit from the bottom of the well casing as shown in FIG. 3. Note that dense liquids settle to the bottom. Note that DNAPL terminal 18 is connected to the bottom of resistance network 10 of conductive circuit 2. In the example shown in FIG. 3, the water/DNAPL interface in the well is at the level of the contacts at transistor Q7. The water bridges the contacts and current is allowed to flow to transistor Q7 and the transistor behaves like a closed switch from the collector to the emitter. Transistors Q8, Q9, and Q10 behave like open switches since DNAPLs are non conductive liquids and current is not allow to flow to the base of these transistors. Therefore, the resistance measured from the bottom of the well to ground, established by the presence of water at transistor Q7, is 40-ohms which is the sum of the four 10-ohm resistors (R7+R8+R9+R10). This measured resistance from DNAPL terminal 18 to ground corresponds to the thickness of the DNAPL 0.04 feet (10-ohms per 0.01-feet). The depth of DNAPL is determined by subtracting the DNAPL thickness from the measured resistance of the total depth of the well as follows:

0.10 feet−0.04 feet=0.06 feet.

The volume of DNAPL in the well is calculated using the measured thickness of the DNAPL and the inside diameter of the well casing.

Figure 4:
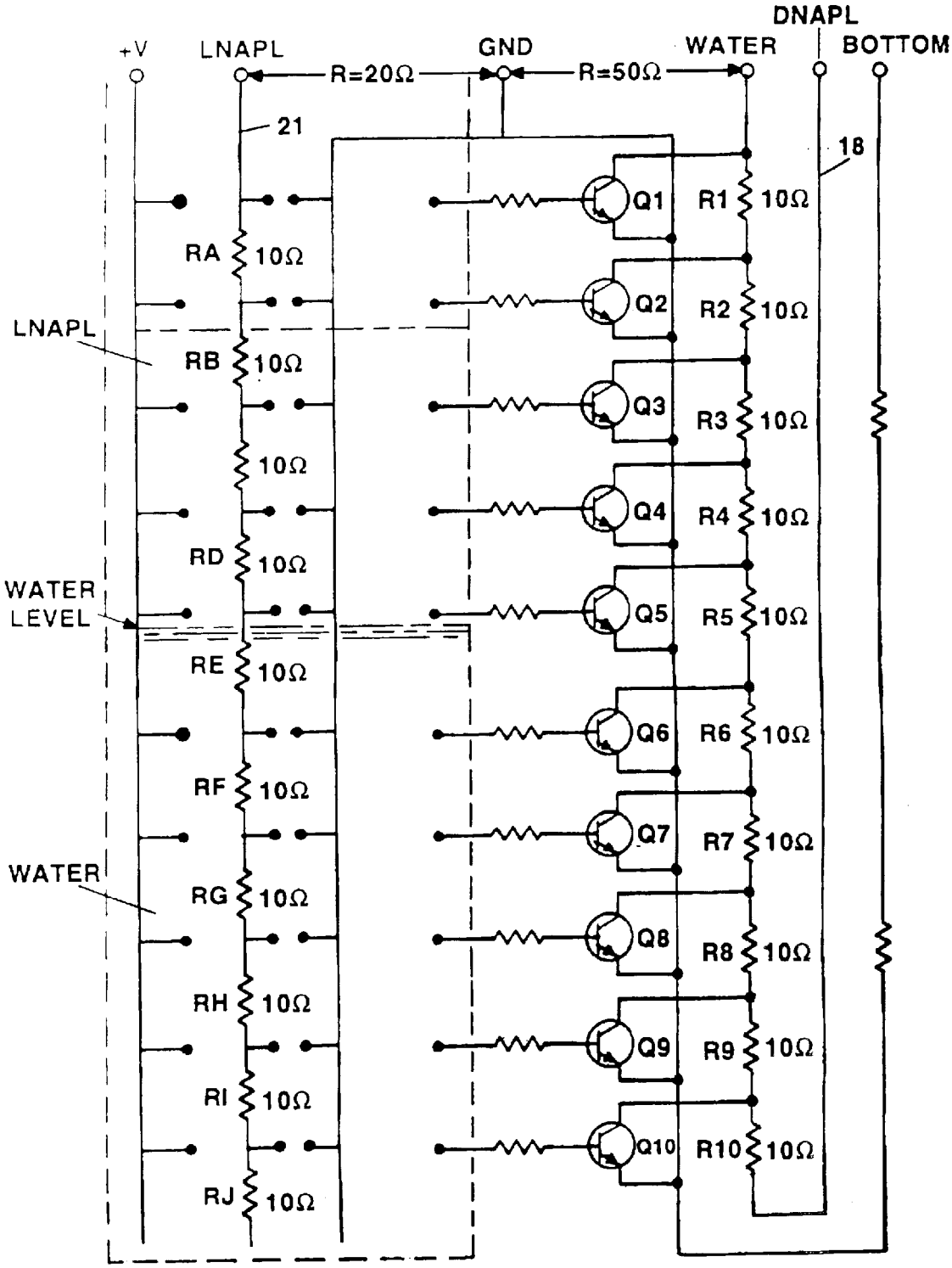
FIG. 4 illustrates measurement of a layer of LNAPL

The depth to any LNAPL is determined by measuting the resistance of the hydrostatic from the top of the well casing as shown in FIG. 4. Note that light liquids rise to the top of the water column, lithe measured resistance of the hydrostatic circuit 7 is equal to the measured resistance of the conductive circuit 2, then no LNAPL is present, as shown in FIG. 2. As shown in FIG. 4, if the measured resistance of the hydrostatic circuit (20-ohms) is less than the measured resistance of the conductive circuit (then a LNAPL is present in the well). The measured resistance represents the depth of the LNAPL and is equal to 0.02 feet (10-ohms per 0.01-feet). The thickness of the LNAPL can then be determined by subtracting the measured resistance of the hydrostatic circuit from the measured resistance of the conductive circuit as follows:

0.05 feet−0.02 feet=0.03 feet.

The volume of LNAPL in the well is calculated using the measured thickness of the LNAPL and the inside diameter of the well casing.

Thus, data processor 25 positioned at the top of the well is employed to processes the conductive liquid output signals and the all liquids output signals for determining layer thickness, and by multiplication with well diameter measurements, volumes of layers of groundwater and any light or dense non-aqueous non-electrically conductive phase liquid in the well.

Since variations on the aforesaid description will occur to one skilled in the art, the invention is to be restricted solely to the following terms in the claims and also art recognized equivalents thereof. For example, the resistive networks could comprise equivalent non-resistive impedance devices if AC was substituted for the DC source. The term "well" as used herein is intended to cover any container, storage tank, receptacle or reservoir for a liquid and not just a conventional ground water well.

I claim:

1. A method for gauging water and non-electrically conductive light or dense non-aqueous liquid contaminants, LNAPL or DNAPL respectively, that can eliminate cross-contamination between wells comprising the steps of:

(a) installing an elongated sensor extending down the entire length of a well, said elongated sensor having (a-1) a conductive liquid circuit, including a first resistive network extending down the entire length of the well, for sensing electrically conductive liquids only; together with (a-2) a hydrostatic circuit that responds to the actuation pressure of conductive and non-conductive liquids, said hydrostatic sensing circuit including a second resistive network extending down the entire length of the well; together with (a-3) a well depth sensing circuit, including a third resistive network extending down the entire length of the well;

(b) after completion of installation of the elongated sensor in accordance with step (a), measuring the electrical resistance of the first resistive network of said conductive liquid circuit from the top of the well to produce a conductive liquid depth signal indicating the depth of the electrically conductive liquid in the well;

(c) after completion of installation in accordance with step (a), measuring the electrical resistance of the second resistive network of said hydrostatic circuit from the top of the well to produce all liquid depth signal indicating the depth of all liquids including said LNAPL in the well if present;

(d) after completion of installation in accordance with step (a), comparing the measured resistance of the hydrostatic circuit with the measured resistance of the conductive liquid circuit and recording any difference therebetween indicative of the thickness of the LNAPL layer;

(e) after completion of installation in accordance with step (a), measuring the resistance of the conductive liquid circuit from the bottom of the well and recording this measured resistance from the bottom of the well as indicative of the thickness of said DNAPL;

(f) after completion of installation in accordance with strep (a), measuring the resistance of said third resistive network indicating the length of said well mud subtracting the measured resistance recorded in accordance with step (e) from the resistance of said third resistive network to record the depth of a DNAPL layer if present;

(g) after completion of installation in accordance with step (a), subtracting the measured resistance of the conductive liquid circuit in the measured resistance of said third restive network to record the height of the conductive liquid column.

2. The method of claim 1 including recording the volume of each different type of liquid that may be present by multiplying the thickness of each liquid layer by a factor including a well casing inside diameter.

3. The method of claim 1 wherein data produced by execution of the steps of claim 1 are recorded by a portable digital processor temporarily connected to the top of the well.

4. The method of claim 2 wherein data produced by execution of the steps of claim 1 are recorded by a portable digital processor temporarily connected to the top of the well.

5. The method of claim 1 wherein the installation step (a) involves permanently installing said elongated sensor within said well.

6. The method of claim 2 wherein the installation step (a) involves permanently installing said elongated sensor within said well.

7. The method of claim 3 wherein the installation step (a) involves permanently installing said elongated sensor within said well.

8. The method of claim 4 wherein the installation step (a) involves permanently installing said elongated sensor within said well.

9. Apparatus for ganging water and non-electrically conductive light or dense non-aqueous liquid contaminants, LNAPL or DNAPL respectively, that can eliminate cross-contamination between wells comprising:

(a) means for positioning an elongated sensor extending down the entire length of a well before measurements are taken, said elongated sensor having (a-1) a conductive liquid circuit, including a first resistive network of serially connected resistors extending down the entire length of the well, for sensing eclectically conductive liquids only; along with (a-2) a hydrostatic circuit that responds to the actuation pressure of conductive and non-conductive liquids, said hydrostatic circuit including a second resistive network of serially connected resisters extending down the entire length of the well; along with (a-3) a well depth sensing circuit, including a third resistive network of serially connected resistors extending down the entire length of the well;

(b) means for measuring the electrical resistance of the first resistive network of said conductive liquid circuit from the top of the well to produce a conductive liquid depth signal indicating the depth of the conductive liquid in the well;

(c) means for measuring the electrical resistance of the second resistive network of said hydrostatic circuit from the top of the well to produce an all liquid depth signal indicating the depth of all liquids including said LNAPL in the well if present;

(d) means for comparing the measured resistance of the hydrostatic circuit with the measured resistance of the conductive liquid and recording any difference therebetween indicative of the thickness of the LNAPL layer;

(e) means for measuring the resistance of the conductive liquid circuit from the bottom of the well and if greater than zero, recording this measured resistance from the bottom of the well as indicative of the thickness of said DNAPL;

(f) means for measuring the resistance of said third resistive network indicating the length of said well and subtracting the measured resistance recorded by the measuring means of paragraph (e) from the resistance of said third resistive network to record the depth of an DNAPL layer if present;

(g) means for subtracting the measured resistance of the conductive liquid circuit from the measured resistance of said third restive network to record the height of the conductive liquid column.

10. The apparatus of claim 9 including means for recording data indicative of the volume of each different type of liquid that may be present by multiplying thickness of each liquid layer by a factor including a well casing inside diameter.

11. The apparatus of claim 9 wherein a portable digital processor records data produced by the apparatus of claim 9.

12. The apparatus of claim 10 wherein a portable digital processor records data produced by the apparatus of claim 9.

13. The apparatus of claim 9 including means for permanently positioning said elongated sensor along the entire length of said well.

14. The apparatus of claim 10 including means for permanently positioning said elongated sensor along the entire length of said well.

15. The apparatus of claim 11 including means for permanently positioning said elongated sensor along the entire length of said well.

16. The apparatus of claim 12 including means for permanently positioning said elongated sensor along the entire length of said well.

17. Apparatus employing an elongated sensor having a length that can extend along the entire length of a well for sensing electrically conductive water and non-electrically conductive non-aqueous liquid contaminants within said well comprising:

(a) a conductive liquid circuit, including a first resistive network of serially connected resistors extending down the entire length of said well, for sensing electrically conductive liquids only;

(b) a hydrostatic circuit that responds to the actuation pressure of conductive and non-conductive liquids, said hydrostatic sensing circuit including a second resistive network of serially connected resistors extending down the entire length of said well; and (a-3) a well depth sensing circuit, including a third resistive network of serially connected resistors extending down the entire length of said well.

18. Apparatus of claim 17 wherein said elongated sensor comprises a tape coupled to tape support means extending along the length of the well for retaining said tape in place within said well between well inspections, thereby eliminating lowering sensors into said well that may require subsequent decontamination procedures.

19. The apparatus of claim 17 wherein said elongated sensor is in the form of a thin film tape.

20. Apparatus of claim 17 wherein a conductive liquid sensing means is coupled to each resistor of said first resistive network for effectively removing a resistor from said first resistive network should a conductive liquid contact said conductive liquid sensing means.

21. Apparatus of claim 18 wherein a conductive liquid sensing means is coupled to each resistor of said first resistive network for effectively removing a resistor from said first resistive network should a conductive liquid contact said conductive liquid sensing means.

22. Apparatus of claim 19 wherein a conductive liquid sensing moans is coupled to each resistor of said first resistive network for effectively removing a resistor from said first resistive network should a conductive liquid contact said conductive liquid sensing means.

23. Apparatus of claim 20 wherein each conductive liquid sensing moans includes an associated tiny conductive contact positioned within said tape, thereby enabling very precise liquid level measurements.

24. Apparatus of claim 21 wherein each conductive liquid sensing means includes an associated tiny conductive contact positioned within said tape, thereby enabling very precise liquid level measurements.

25. Apparatus of claim 22 wherein each conductive liquid sensing means includes an associated tiny conductive contact positioned within said tape, thereby enabling very precise liquid level measurements.

26. Apparatus for measuring non-electrically conductive light or dense non-aqueous liquid contaminants, LNAPL or DNAPL respectively, that can eliminate cross-contamination between wells comprising:

(a) means for supporting an elongated sensor extending down the entire length of a well before measurements are taken and having a conductive liquid circuit, including a first resistive network of serially connected resistors extending down the entire length of the well, for sensing electrically conductive liquids only, and a hydrostatic circuit that responds to the actuation pressure of conductive and non-conductive liquids, said hydrostatic circuit including a second resistive network of serially connected resistors extending clown the entire length of the well;

(b) a portable digital processor having the following components:

(b-1) means for measuring the electrical resistance of the first resistive network of said conductive liquid circuit from the top of the well to produce a conductive liquid depth signal indicating the depth of the conductive liquid in the well; together with (b-2) means for measuring the electrical resistance of the second resistive network of said hydrostatic circuit from the top of the well to produce an all liquid depth signal indicating the depth of all liquids including said LNAPL in the well if present; together with (b-3) means for comparing the measured resistance of the hydrostatic circuit with the measured resistance of the conductive liquid circuit and recording any difference therebetween indicative of the thickness of the LNAPL layer; together with (b-4) measuring means for measuring the resistance of the conductive liquid circuit from the bottom of the well and if greater than zero, recording this measured resistance from due bottom of the well as indicative of the thickness of said DNAPL layer.

27. Apparatus for measuring non-electrically conductive light or dense non-aqueous liquid contaminants, LNAPL or DNAPL respectively, that can eliminate cross-contamination between wells comprising:

(a) means for supporting an elongated sensor extending down the entire length of a well before measurements are taken and having:

(a-1) a conductive liquid circuit, including a first resistive network extending down the entire length of the well, for sensing electrically conductive liquids only, together with (a-2) a hydrostatic circuit that responds to the actuation pressure of conductive and non-conductive liquids, said hydrostatic circuit including a second resistive network extending down the entire length of the well;

(b) means for measuring the electrical resistance of the first resistive network of said conductive liquid circuit from the top of the well to produce a conductive liquid depth signal indicating the depth of the conductive liquid in the well;

(c) means for measuring the electrical resistance of the second resistive network of said hydrostatic circuit from the top of the well to produce an all liquid depth signal indicating the depth of all liquids including said LNAPL in the well if present;

(d) means for comparing the measured resistance of the hydrostatic circuit with the measured resistance of the conductive liquid circuit and recording any difference therebetween indicative of the thickness of the LNAPL layer;

(e) measuring means for measuring the resistance of the conductive liquid circuit from the bottom of the well and if greater than zero, recording this measured resistance from the bottom of the well as indicative of the thickness of said DNAPL layer.

* * * * *